US007074465B2

(12) United States Patent
Campbell et al.

(10) Patent No.: US 7,074,465 B2
(45) Date of Patent: Jul. 11, 2006

(54) INKJET RECORDING ELEMENT COMPRISING POLYESTER IONOMER AND A METHOD OF USE

(75) Inventors: Bruce C. Campbell, Webster, NY (US); Thomas M. Laney, Spencerport, NY (US); Mridula Nair, Penfield, NY (US); Lisa B. Todd, Rochester, NY (US); Kenneth W. Best, Jr., Hilton, NY (US)

(73) Assignee: Eastman Kodak Company, Rochester, NY (US)

( * ) Notice: Subject to any disclaimer, the term of this patent is extended or adjusted under 35 U.S.C. 154(b) by 311 days.

(21) Appl. No.: 10/742,164

(22) Filed: Dec. 19, 2003

(65) Prior Publication Data

US 2005/0134667 A1 Jun. 23, 2005

(51) Int. Cl.
*B41M 5/40* (2006.01)

(52) U.S. Cl. ..... 428/32.17; 428/32.18; 428/32.27; 428/32.28; 428/32.35; 347/105

(58) Field of Classification Search ..... 428/32.17, 428/32.18, 32.27, 32.28, 32.35; 437/105
See application file for complete search history.

(56) References Cited

U.S. PATENT DOCUMENTS

| | | | | |
|---|---|---|---|---|
| 6,379,780 | B1 * | 4/2002 | Laney et al. | 428/32.18 |
| 6,409,334 | B1 * | 6/2002 | Campbell et al. | 347/106 |
| 6,489,008 | B1 | 12/2003 | Campbell et al. | 428/195 |

FOREIGN PATENT DOCUMENTS

| | | |
|---|---|---|
| EP | 1 112 858 A2 | 7/2001 |
| EP | 1 184 192 A2 | 3/2002 |
| EP | 1 184 193 A2 | 3/2002 |
| EP | 1 310 378 A2 | 5/2003 |
| JP | 2000 037835 | 2/2000 |

* cited by examiner

*Primary Examiner*—B. Shewareged
(74) *Attorney, Agent, or Firm*—Chris P. Konkol

(57) ABSTRACT

An inkjet recording element comprising an ink-permeable microvoided substrate comprising a porous ink-receiving layer over and adjacent to an ink-permeable microvoided substrate layer comprising, in a polyester continuous phase, a polyester ionomer, wherein the microvoided substrate layer and the porous ink-receiving layer both having interconnecting voids. Also disclosed is an inkjet printing process, comprising the step of providing an ink-jet printer with such an inkjet recording element.

35 Claims, No Drawings

INKJET RECORDING ELEMENT COMPRISING POLYESTER IONOMER AND A METHOD OF USE

FIELD OF THE INVENTION

This invention relates to an inkjet recording element. More particularly, this invention relates to an inkjet recording element containing a porous ink receiving layer having interconnecting voids and an ink-permeable polyester microvoided substrate comprising a polyester ionomer.

BACKGROUND OF THE INVENTION

In a typical inkjet recording or printing system, ink droplets are ejected from a nozzle at high speed towards a recording element or medium to produce an image on the medium. The ink droplets, or recording liquid, generally comprise a recording agent, such as a dye or pigment, and a large amount of solvent. The solvent, or carrier liquid, typically is made up of water, an organic material such as a monohydric alcohol, a polyhydric alcohol, or mixtures thereof.

An inkjet recording element typically comprises a support having on at least one surface thereof an ink-receiving or image-forming layer, and includes those intended for reflection viewing, which have an opaque support, and those intended for viewing by transmitted light, which have a transparent support.

While a wide variety of different types of image-recording elements for use with inkjet devices have been proposed heretofore, there are many unsolved problems in the art and many deficiencies in the known products which have limited their commercial usefulness.

It is well known that in order to achieve and maintain photographic-quality images on such an image-recording element, an ink-jet recording element must be readily wetted so there is no puddling, i.e., coalescence of adjacent ink dots, which leads to non-uniform density; exhibit no image bleeding; exhibit the ability to absorb high concentrations of ink and dry quickly to avoid elements blocking together when stacked against subsequent prints or other surfaces; exhibit no discontinuities or defects due to interactions between the support and/or layer(s), such as cracking, repellencies, comb lines and the like; not allow unabsorbed dyes to aggregate at the free surface causing dye crystallization, which results in bloom or bronzing effects in the imaged areas; and exhibit an optimized image fastness to avoid fade from contact with water or radiation by daylight, tungsten light, or fluorescent light.

Given the wide range of ink compositions and ink volumes that a recording element needs to accommodate, these requirements of inkjet recording media are difficult to achieve simultaneously.

While a wide variety of different types of image-recording elements have been proposed heretofore, there are many unsolved problems in the art and many deficiencies in the known products which have limited their commercial usefulness. For example, the recording element must be capable of absorbing or receiving large amounts of ink applied to the image-forming surface of the element as rapidly as possible in order to produce recorded images having good quality, including high optical density and low coalescence, and that can be handled without smearing shortly after printing. Large amounts of ink are often required for printing high quality, photographic-type images.

Inkjet recording elements are known that employ porous single layer or multilayer coatings that act as suitable image receiving layers on one or both sides of a porous or non-porous support. For example, U.S. Pat. No. 6,489,008 discloses an ink-permeable polyester microvoided substrate having thereon a porous image receiving layer having interconnecting voids. Although this inkjet recording element provides fast ink drytimes and good image density when printed with a desktop inkjet printer containing dye-based inks, the drytimes and image quality (coalescence) can suffer when harsher printing conditions, such as wide format inkjet printing with pigmented inks, are used.

It is an object of this invention to provide an inkjet recording element that has a fast ink dry time. It is another object of this invention to provide an inkjet recording element that has good image density.

SUMMARY OF THE INVENTION

It is the object of this invention to provide an inkjet receiving element that is fast drying, has good density and has low coalescence. These and other objects are achieved in accordance with the invention which comprises an inkjet recording element comprising a porous ink-receiving layer over and adjacent to an ink-permeable microvoided substrate layer comprising a polyester ionomer, said substrate layer comprising 5 to 70 percent by weight solids of a neutral polyester; 5 to 40 percent by weight solids of a polyester ionomer; and 25 to 65 percent by weight of a voiding agent, wherein said weight solids are based on the total weight of the microvoided substrate layer in the element, and wherein the microvoided substrate layer and the porous ink-receiving microvoided layer both having interconnecting voids. In one preferred embodiment of the invention, the ink-permeable polyester microvoided substrate layer comprises a sulfonated polyester.

The invention is also directed to an inkjet printing process, comprising the steps of:

A) providing an inkjet printer that is responsive to digital data signals;

B) loading the printer with the inkjet recording element;

C) loading the printer with an inkjet ink compositions; and

D) printing on the inkjet recording element using the inkjet ink compositions in response to the digital data signals.

The term "ink-permeable" is defined by the Applicants to mean that either the ink recording agent and/or the carrier for the recording agent is capable of being efficiently transported into the polyester microvoided substrate layer during use.

The terms, as used herein, "top" or "upper," means the side or toward the side of the ink-receiving layer. The terms "bottom" and "lower" mean the side or toward the side of the support. The terms "over" or "above," with respect to upper and lower layers do not necessarily refer to adjacent or touching layers and do not exclude intermediate positioned layers unless explicitly so stated.

DETAILED DESCRIPTION OF THE INVENTION

The ink-permeable polyester microvoided substrate layer used in the invention can be made by the addition of a polyester ionomer to at least the ink-permeable upper polyester layer of the polyester substrate disclosed in U.S. Pat.

No. 6,489,008 to Campbell et al. and U.S. Pat. No. 6,379,780 of Laney et al., hereby incorporated by reference in their entirety.

As mentioned above, the microvoided substrate layer used in this invention has rapid absorption of ink, as well as high absorbent capacity, which allows rapid printing and a short dry time. A short dry time is advantageous, as the prints are less likely to smudge and have higher image quality as the inks do not coalesce prior to drying.

In one embodiment of the invention, the inkjet recording element can consist essentially of only the porous image-receiving layer and the microvoided substrate layer, wherein the latter also serves as a monolayer support.

In yet another embodiment of the invention, the inkjet recording element comprises a two-layer substrate comprising an upper layer and base layer in which, on the side opposite the ink-receiving layer, the microvoided substrate layer is an upper layer adjacent to a substantially ink-impermeable polyester base layer. Typically, the microvoided substrate layer and the base layer are coextruded as described below. Optionally, the recording element can further comprise paper laminated to the side of said base layer on the side of the base layer not having thereon said image-receiving layer.

In another embodiment of the invention, the inkjet recording element comprises a three-layer substrate further comprising a polyester microvoided lower layer under and adjacent the base layer on the opposite side from the ink-permeable microvoided substrate layer, wherein said lower permeable layer has interconnecting voids. In this case, also, the microvoided substrate layer, base layer, and lower layer can be coextruded to form a support for a coated ink-receiving layer.

Such a two-layer or three-layer substrate can form a support that has the look and feel of paper, has a desired surface look without pearlescence, is weather resistant and resistant to curling under differing humidity conditions, and has a high resistance to tearing and deformation.

In one embodiment, the base layer can comprise a voiding agent to an extent less than about 25% by volume or comprise no voiding agent and comprises poly(ethylene terephthalate).

In a preferred embodiment of the invention, the microvoided substrate layer used in the present invention comprises a continuous polyester phase preferably comprising poly(ethylene terephthalate), poly(ethylene-1,4-cyclohexylenedimethylene terephthalate), or blends thereof; the microvoided substrate layer comprises a voiding agent present in an amount of from about 30% to about 50% by volume of said microvoided substrate layer; and the voiding agent are particles having an average particle size of from about 5 nm to about 15 μm.

In a preferred multilayer substrate, the base and upper layers can be a coextruded material having levels of voiding, thickness, and smoothness adjusted to provide optimum ink absorbency, stiffness, and gloss properties. The microvoided upper layer can contain voids to efficiently absorb the printed inks commonly applied to inkjet imaging supports without the need of multiple processing steps and multiple coated layers, while the base layer of the substrate can provide stiffness to the substrate and provide physical integrity to the permeable microvoided upper layer. In such embodiments, the thickness of the base layer is chosen so that the total substrate thickness is 50 to 500 μm depending on the required stiffness of the film, and the thickness of the microvoided upper layer is adjusted to the total absorbent capacity of the ink recording element. A thickness of at least 28.0 μm is needed to achieve a total absorbency of 14 cc/m$^2$.

As indicated above, the ink-permeable polyester microvoided substrate layer used in the present invention preferably contains voids that are interconnected or open-celled. This type of structure enhances ink absorption rate by enabling capillary action to occur. Preferably, the ink-permeable microvoided substrate layer has an absorbing rate resulting in a dry time of less than 10 seconds. Dry time may be measured by printing a color line on the side of the upper layer with an HP 722 ink-jet printer using a standard HP dye-based ink cartridge (HP # C1823A) at a laydown of approximately 14 cc/m$^2$ and using the test ink formulations described in U.S. Pat. No. 6,379,780.

Dry time is measured by superposing a piece of bond paper on top of the printed line pattern immediately after printing and pressing the papers together with a roller press. If a particular printed line transfers to the surface of the bond paper, its transferred length L could be used for estimating the dry time $t_D$ using a known linear transport speed S for the printer based on the formula $$t_D = \frac{L}{S}$$

In a preferred embodiment, the ink absorbency rate results in a measured dry time of less than about one second.

In the preferred embodiment, the microvoided layer should have a total absorbant capability of at least 14.0 cc/m$^2$, i.e., should be such as to enable at least 14.0 cc of ink to be absorbed per 1 m$^2$. This is a calculate number, based on the thickness of the microvoided substrate layer. The actual thickness can be determined by using the formula t=14.0/v where v is the void volume fraction defined as the ratio of voided thickness minus unvoided thickness to the voided thickness. The actual thickness, if an extruded monolayer, can be easily measured. If a co-extruded layer, photomicroscopy of a cross-section can be used to determine the actual thickness. The unvoided thickness is defined as the thickness that would be expected had no voiding occurred, for example, the cast thickness divided by the stretch ratio in the machine direction and the stretch ratio in the cross direction.

The non-ionic polyester material utilized in microvoided substrate layer, in general, should have a glass transition temperature between about 50° C. and 150° C., preferably between about 60–100° C., should be stretchable, and have an inherent viscosity of at least about 0.5, preferably about 0.6 to about 0.9 dl/g. Suitable polyesters include those produced from aromatic, aliphatic, or cycloaliphatic dicarboxylic acids of 4–20 carbon atoms and aliphatic or alicyclic glycols having from 2–24 carbon atoms. Examples of suitable dicarboxylic acids include terephthalic, isophthalic, phthalic, naphthalene dicarboxylic acid, succinic, glutaric, adipic, azelaic, sebacic, fumaric, maleic, itaconic, 1,4-cyclohexane-dicarboxylic, sodiosulfoisophthalic, and mixtures thereof. Examples of suitable glycols include ethylene glycol, propylene glycol, butanediol, pentanediol, hexanediol, 1,4-cyclohexane-dimethanol, diethylene glycol, other polyethylene glycols and mixtures thereof. Such polyesters are well known in the art and may be produced by well known techniques e.g., those described in U.S. Pat. Nos. 2,465,319 and 2,901,466, the disclosures of which are hereby incorporated by reference. Preferred continuous matrix polymers are those that have repeat units from terephthalic acid or naphthalene dicarboxylic acid and at least one glycol selected from ethylene glycol, 1,4-butanediol, and 1,4-cyclohexanedimethanol. Poly(ethylene terephthalate), which may be modified by small amounts of other monomers, is especially preferred. Other suitable polyesters include liquid crystal copolyesters formed by the inclusion of a suitable amount of a co-acid component such as stilbene dicarboxylic acid. Examples of such liquid crystal copolyesters are those disclosed in U.S. Pat. Nos. 4,420,607; 4,459,402; and 4,468,510, the disclosures of which are hereby incorporated by reference.

With reference to a preferred polyester material for the microvoided substrate layer, definitions of terms, used herein, include the following:

Monomeric units derived from 1,4-cyclohexane dimethanol (CHDM) are also referred to as "CHDM repeat units" or "CHDM comonomer units."

By "terephthalic acid" or "TPA," suitable synthetic equivalents, such as dimethyl terephthalate, are included. It should be understood that "dicarboxylic acids" of any type, not only TPA, includes the corresponding acid anhydrides, esters and acid chlorides for these acids. The total levels of glycol or acid components in a polyester or material of this invention are equal to a total of 100 mol %.

"PET," "PET polymer," "PET resin," "poly(ethylene terephthalate) resin," and the like refers to a polyester comprising at least 98 mol % terephthalic acid comonomer units, based on the total acid component, and comprising at least 98 mol % of ethylene glycol comonomer units, based on the total glycol component. This includes PET resins consisting essentially of about 100 mol % terephthalic acid comonomer units, based on the total acid component, and consisting essentially of about 100 mol % of ethylene glycol comonomer units, based on the total glycol component.

The term "modified PET polymer," "modified PET resin," or the like is a polyester comprising at least 70 mol % terephthalic acid comonomer units, based on the total acid component, that has been modified so that either the acid component is less than 98 mol % of terephthalic acid (TPA) comonomer units or the glycol component is less than 98 mol % of ethylene glycol (EG) comonomer units, or both the EG and TPA comonomer units are in an amount less than 98 mol %. The modified PET polymer is modified with, or copolymerized with, one or more comonomers other than terephthalic acid comonomers and/or ethylene glycol comonomers in an amount of greater than 2 mol % (including greater than 5 mol %), of either the acid component and/or the glycol component.

The term "CHDM-modified PET" or "CHDM-modified PET polyester" refers to a "modified PET polymer" modified by the inclusion of at least 2 mol % (including at least 3.5 mol %) of CHDM comonomer units based on total glycol component.

"PET-based polyester material" is a material comprising one or more polymers wherein at least 70% by weight of the material is one or more polymers that are either a PET polymer or a modified PET polymer. Of course, the material may also include other components or addenda such as voiding agents, plasticizers, and the like.

In the microvoided substrate layer of the present invention, the polyester continuous phase is made of a PET-based polyester material and a polyester ionomer.

In the embodiments comprising a base layer, which base layer is usually substantially impermeable, the polyester for the base layer is preferably poly(ethylene terephthalate) or copolymers thereof.

Voids in the ink-permeable polyester microvoided substrate layer may be obtained by using microbeads during its fabrication. Such microbeads may be inorganic fillers or polymerizable organic materials. The particle size of the microbeads is preferably in the range of from about 0.1 to about 50 μm, more preferably from about 0.5 to about 5 μm, for best formation of an ink porous but smooth surface. The microbeads may be employed in an amount of 30–50% by volume in the feed stock for the ink-permeable upper polyester layer prior to extrusion and microvoiding. Typical inorganic materials for the microbeads include silica, alumina, calcium carbonate, and barium sulfate. Typical polymeric organic materials for the microbeads include polystyrenes, polyamides, fluoro polymers, poly(methyl methacrylate), poly(butyl acrylate), polycarbonates, and polyolefins.

It is possible for the voids of this second voided layer or the microvoided layer to be formed by, instead of particles, by finely dispersing a polymer incompatible with the matrix ionomer-based material and stretching the film uniaxially or biaxially. (It is also possible to have mixtures of particles and incompatible polymers.) When the film is stretched, a void is formed around each particle of the incompatible polymer. Since the formed fine voids operate to diffuse a light, the film is whitened and a higher reflectance can be obtained. The incompatible polymer is a polymer that does not dissolve into the ionomer. Examples of such an incompatible polymer include poly-3-methylbutene-1, poly-4-methylpentene-1, polypropylene, polyvinyl-t-butane, 1,4-transpoly-2,3-dimethylbutadiene, polyvinylcyclohexane, polystyrene, polyfluorostyrene, cellulose acetate, cellulose propionate, and polychlorotrifluoroethylene. Among these polymers, polyolefins such as polypropylene are suitable.

The polyester ionomer used in the microvoided substrate layer is a substantially amorphous, thermoplastic polymer in which ionic groups or moieties are present in sufficient number to provide water dispersibility prior to coating.

Procedures for the preparation of polyester ionomers are described in U.S. Pat. Nos. 3,018,272; 3,563,942; 3,734,874; 3,779,993; 3,929,489; 4,307,174; 4,395,475; 5,939,355; and 3,929,489, the disclosures of which are incorporated herein by reference. The substantially amorphous polyesters useful in this invention comprise dicarboxylic acid recurring units typically derived from dicarboxylic acids or their functional equivalents and diol recurring units typically derived from diols. Generally, such polyesters are prepared by reacting one or more diols with one or more dicarboxylic acids or their functional equivalents (e.g. anhydrides, diesters, or diacid halides), as described in detail in the cited patents. Such diols, dicarboxylic acids and their functional equivalents are sometimes referred to in the art as polymer precursors. It should be noted that, as known in the art, carbonylimino groups can be used as linking groups rather than carbonyloxy groups. This modification is readily achieved by reacting one or more diamines or amino alcohols with one or more dicarboxylic acids or their functional equivalents. Mixtures of diols and diamines can be used if desired.

Conditions for preparing the polyesters useful in this invention are known in the art as described above. The polymer precursors are typically condensed in a ratio of at least 1 mole of diol for each mole of dicarboxylic acid in the presence of a suitable catalyst at a temperature of from about 125° to about 300° C. Condensation pressure is typically from about 0.1 mm Hg to about one or more atmospheres. Low-molecular weight by-products can be removed during condensation, e.g. by distillation or another suitable technique. The resulting condensation polymer is polycondensed under appropriate conditions to form a polyester. Polycondensation is usually carried out at a temperature of from about 150° to about 300° C. and a pressure very near vacuum, although higher pressures can be used.

The "ionomers" or "polyester ionomers" used in the present invention contain at least one ionic moiety, which can also be referred to as an ionic group, functionality, or radical. In a preferred embodiment of this invention, the recurring units containing ionic groups are present in the polyester ionomer in an amount of from about 1 to about 12 mole percent, based on the total moles of recurring units. Such ionic moieties can be provided by either ionic diol recurring units and/or ionic dicarboxylic acid recurring units, but preferably by the latter. Such ionic moieties are anionic. Exemplary anionic ionic groups include carboxylic acid, sulfonic acid, and disulfonylimino and their salts and others known to a worker of ordinary skill in the art. Sulfonic acid ionic groups, or salts thereof, are preferred.

One type of ionic acid monomeric unit for the polyester ionomer has the following structure:

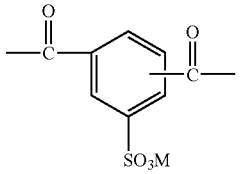

I where M=H, Na, K or $NH_4$.

Ionic dicarboxylic acid recurring units can be derived, for example, from 5-sodiosulfobenzene-1,3-dicarboxylic acid (5-sodium sulfoisophthalic acid), 2-sodium sulfoisophthalic acid, 4-sodium sulfoisophthalic acid, 4-sodium sulfo-2,6-naphthalene dicarboxylic acid, or ester-forming derivatives, 5-sodiosulfocyclohexane-1,3-dicarboxylic acid, 5-(4-sodiosulfophenoxy)benzene-1,3-dicarboxylic acid, 5-(4-sodiosulfophenoxy)cyclohexane-1,3-dicarboxylic acid, similar compounds and functional equivalents thereof and others described in U.K. Patent Specification No. 1,470,059 (published Apr. 14, 1977). Other suitable polyester ionomers for use in the present invention are disclosed in U.S. Pat. Nos. 4,903,039 and 4,903,040, which are incorporated herein by reference.

Another type of aromatic dicarboxylic acid having a metal sulfonate group is shown below:

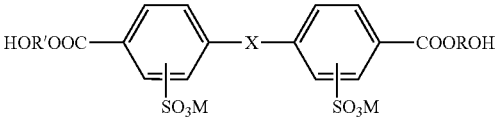

wherein X represents:

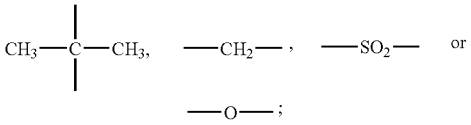

R and R' each represent $—(CH_2)_n—$ where n represents an integer of 1 to 20; and a compound in which each of these sodium atoms is substituted by another metal (e.g. potassium and lithium).

Another type of ionic dicarboxylic acid found useful in the practice of this invention are those having units represented by the formula:

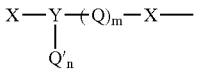

wherein each of m and n is 0 or 1 and the sum of m and n is 1; each X is carbonyl; Q has the formula:

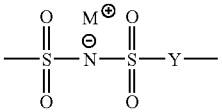

Q' has the formula:

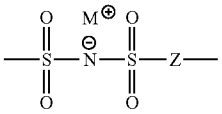

Y is a divalent aromatic radical, such as arylene (e.g. phenylene, naphthalene, xylylene, etc.) or arylidyne (e.g. phenenyl, naphthylidyne, etc.); Z is a monovalent aromatic radical, such as aryl, aralkyl or alkaryl (e.g. phenyl, p-methylphenyl, naphthyl, etc.), or alkyl having from 1 to 12 carbon atoms, such as methyl, ethyl, isopropyl, n-pentyl, neopentyl, 2-chlorohexyl, etc., and preferably from 1 to 6 carbon atoms; and M is a solubilizing cation and preferably a monovalent cation such as an alkali metal or ammonium cation.

Exemplary dicarboxylic acids and functional equivalents of this type from which such ionic recurring units are derived are 3,3'-[(sodioimino)disulfonyl]dibenzoic acid;

3,3'-[(potassioimino)disulfonyl]dibenzoic acid, 3,3'-[(lithioimino)disulfonyl]dibenzoic acid;

4,4'-[(lithioimino)disulfonyl]dibenzoic acid;

4,4'-[(sodioimino)disulfonyl]dibenzoic acid;

4,4'-[(potassioimino)disulfonyl]dibenzoic acid; 3,4'-[(lithioimino)disulfonyl]dibenzoic acid;

3,4'-[(sodioimino)disulfonyl]dibenzoic acid;

5-[4-chloronaphth-1-ylsulfonyl(sodioimino)sulfonyl]isophthalic acid; 4,4'-[(potassioimino)disulfonyl]dinaphthoic acid;

5-[p-tolylsulfonyl(potassioimino)sulfonyl]isophthalic acid; 4-[p-tolylsulfonyl(sodioimino)sulfonyl]-1,5-naphthalenedicarboxylic acid;

5-[n-hexylsulfonyl(lithioimino)sulfonyl]isophthalic acid; 2-[phenylsulfonyl(potassioimino)sulfonyl]terephthalic acid and functional equivalents thereof. These and other dicarboxylic acids useful in forming preferred ionic recurring units are described in U.S. Pat. No. 3,546,180 (issued Dec. 8, 1970 to Caldwell et al.) the disclosure of which is incorporated herein by reference.

A preferred monomeric unit of this type has the following structure:

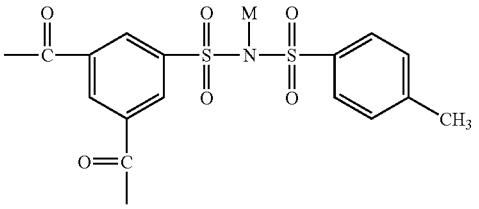

wherein M is as defined above.

It is also possible to have combinations of different ionic groups in the same recurring unit of a polyester ionomer, for example, as shown in U.S. Pat. No. 5,534,478 (the last structure in column 3).

One preferred class of substantially amorphous polyester ionomers employable in the present invention comprises the polymeric reaction product of: a first dicarboxylic acid; a second dicarboxylic acid comprising an aromatic nucleus to which is attached sulphonic acid group; an aliphatic diol compound, and an aliphatic cycloaliphatic diol compound. The second dicarboxylic acid comprises from about 2 to 25 mol percent of the total moles of first and second dicarboxylic acids. The second diol comprises from about 0 to 50 mol percent of the total moles of the first and second diol.

The first dicarboxylic acid or its anhydride, diester, or diacid halide functional equivalent may be represented by the formula: —CO—$R_1$—CO— where $R_1$ is a saturated or unsaturated divalent hydrocarbon, an aromatic or aliphatic group or contains both aromatic and aliphatic groups. Examples of such acids include isophthalic acid, 5-t-butylisophthalic acid, 1,1,3-trimethyl-3-4-(4-carboxylphenyl)-5-indancarboxylic acid, terephthalic acid, 2,6-naphthalenedicarboxylic acid, or mixtures thereof. The first acid may also be an aliphatic diacid where $R_1$ is a cyclohexyl unit or 2–12 repeat units of a methylene group, such as succinic acid, adipic acid, glutaric acid and others. The first dicarboxylic acid is preferably an aromatic acid or a functional equivalent thereof, most preferably, isophthalic acid.

The second dicarboxylic acid may be a water-dispersible aromatic acid containing an ionic moiety that is a sulfonic acid group or its metal or ammonium salt as described earlier. Examples include the sodium, lithium, potassium or ammonium salts of sulfoterephthalic acid, sulfonaphthalenedicarboxylic acid, sulfophthalic acid, sulfoisophthalic acid, and 5-(4-sulfophenoxy) isophthalic acid, or their functionally equivalent anhydrides, diesters, or diacid halides. Most preferably, the second dicarboxylic acid comprises a soluble salt of 5-sulfoisophthalic acid or dimethyl 5-sulfoisophthalate. The ionic dicarboxylic acid repeating units of the polyester ionomers employed in accordance with the invention comprise from about 1 to about 25 mol percent, preferably about 10 to 25 mole percent of the total moles of dicarboxylic acids.

The dicarboxylic acid recurring units are linked in a polyester by recurring units derived from difunctional compounds capable of condensing with a dicarboxylic acid or a functional equivalent thereof. Suitable diols are represented by the formula: HO—$R_2$—OH, where $R_2$ is aliphatic, cycloaliphatic, or aralkyl. Examples of useful diol compounds include the following: ethylene glycol, diethylene glycol, propylene glycol, 1,2-cyclohexanedimethanol, 1,2-propanediol, 4,4'-isopropylidene-bisphenoxydiethanol, 4,4'-indanylidene-bisphenoxydiethanol, 4,4'-fluorenylidene-bisphenoxydiethanol, 1,4-cyclohexanedimethanol, 2,2'-dimethyl-1,3-propanediol, p-xylylenediol, and glycols having the general structure $H(OCH_2CH_2)_n$—OH or $H(CH_2)_n$OH, where n=2 to 10. Diethyleneglycol, 1,4-cyclohexanedimethanol, pentanediol, and mixtures thereof are especially preferred.

The polyester ionomers used in this invention have a glass transition temperature (Tg) of about 100° C. or less and, preferably, from about 25° C. to 70° C. Tg values can be determined by techniques such as differential scanning calorimetry or differential thermal analysis, as disclosed in N. F. Mott and E. A. Davis, *Electronic Processes in Non-Crystalline Material*, Oxford University Press, Belfast, 1971, at p. 192. Preferred polyester ionomers for use in the present invention include the Eastek™ polymers previously known as EASTMAN AQ polymers manufactured by Eastman Chemical Company of Kingsport, Tenn.

The ionomer polymers of this invention are relatively high molecular weight (Mn preferably above 10,000, more preferably above about 14,000) substantially amorphous polyesters that disperse directly in water without the assistance of organic co-solvents, surfactants, or amines. As indicated above, this water dispersibility is attributable in large part to the presence of ionic substituents, for example, sulfonic acid moieties or salts thereof, for example, sodiosulfo moieties ($SO_3Na$) in the polymer. Properties of these polymers can be found at their website at www.eastman.com and are described in Publication No. GN-389B of Eastman Chemical Company, dated May 1990, the disclosures of both of which are incorporated herein by reference. Especially preferred is poly[1,4-cyclohexylenedimethylene-co-2,2'-oxydiethylene (46/54) isophthalate-co-5-sodiosulfo-1,3-benzenedicarboxylate (82/18)] (obtained as Eastek® 1100, previously sold as EASTMAN AQ™ 55 polymer, Tg 55° C. from Eastman Chemical Co.).

The commercially available salt forms of the polyester ionomer, including the aforementioned Eastek® polymers, have been shown to be effective in the present invention.

Without wishing to be bound by theory, the presence of the polyester ionomer in the microvoided substrate layer is believed to help make the voided pores of the structure more wettable or hydrophilic, thus tending to draw the ink fluids through faster and improving drytime. For best results, the polyester ionomer should be mixed in the melt for the layer at 5–40% wt, preferably 10–30% wt, and optimally 15–20% wt.

The present invention does not require but permits the use or addition of various organic and inorganic materials such as pigments, anti-block agents, antistatic agents, plasticizers, dyes, stabilizers, nucleating agents, and other addenda known in the art to the microvoided substrate layer. These materials may be incorporated into the polyester melt used to make the microvoided substrate layer using known techniques.

The microvoided substrate layer used in this invention may be made on readily available film formation machines such as employed with conventional polyester materials. The microvoided substrate layer can be monoextruded or coextruded and stretched. The one step formation process leads to low manufacturing cost.

The process for adding the inorganic particle or other void initiator to the polyester matrix is not particularly restricted. The particles can be added in an extrusion process utilizing a twin-screw extruder.

A preferred process for producing one embodiment of a film used in the present invention will now be explained. However, the present invention is not particularly restricted to the use of following process.

Inorganic particles can be mixed into the polyester melt, comprising the non-ionic polyester and the polyester ionomer, in a twin screw extruder at a temperature of 170–220° C. This mixture is extruded through a strand die, cooled in a water bath, and pelletized. The pellets are then dried at 50° C. and fed into an extruder "A".

The molten sheet delivered from the die is cooled and solidified on a drum having a temperature of 40–60° C. while applying either an electrostatic charge or a vacuum. The sheet is stretched in the longitudinal direction at a draw ratio of 2–5 times during passage through a heating chamber at a temperature of 70–90° C. Thereafter, the film is introduced into a tenter while the edges of the film are clamped by clips. In the tenter, the film is stretched in the transverse direction in a heated atmosphere having a temperature of 70–90° C. Although both the draw ratios in the longitudinal and transverse directions are in the range of 2 to 5 times, the area ratio between the non-stretched sheet and the biaxially stretched film is preferably in the range of 9 to 20 times. If the area ratio is greater than 20 times, a breakage of the film is liable to occur. Thereafter, the film is uniformly and gradually cooled to a room temperature, and wound.

Inorganic particles can be incorporated into the continuous polyester phase as described below. These particles can comprise from about 25 to about 65 weight % (preferably from about 35 to about 55 weight %) of the total microvoided layer.

These inorganic particles are at least partially bordered by voids because they are embedded in the microvoids distributed throughout the continuous polyester phase. Thus, the microvoids containing the inorganic particles comprise a second phase dispersed within the continuous ionomer first phase. The microvoids generally preferably occupy from about 40 to about 65% (by volume) of the microvoided layer. The microvoids can be of any particular shape, that is circular, elliptical, convex, or any other shape reflecting the film orientation process and the shape and size of the inorganic particles. The size and ultimate physical properties of the microvoids depend upon the degree and balance of the orientation, temperature and rate of stretching, crystallization characteristics of the polyester material, the size and distribution of the inorganic particles, and other considerations that would be apparent to one skilled in the art. Generally, the microvoids are formed when the extruded sheet containing inorganic particles is biaxially stretched using conventional orientation techniques.

Thus, in one embodiment, the microvoided substrate layer used in the practice of this invention can be prepared by:

(a) blending inorganic particles into a desired melt comprising a non-ionic polyester-based material and a polyester ionomer as the polyester continuous phase;

(b) forming a sheet of the ionomer-containing blended material and inorganic particles, such as by extrusion; and (c) stretching the sheet in one or transverse directions to form microvoids around the inorganic particles.

As noted above, a porous image-receiving layer containing interconnecting voids is used in the inkject recording element over the microvoided substrate layer. The voids in the image-receiving layer provide a pathway for an ink to penetrate appreciably into the substrate, thus allowing the substrate to contribute to the dry time. A non-porous image-receiving layer or a porous image-receiving layer that contains closed cells will not allow the substrate to contribute to the dry time. It is preferred, therefore, that the voids in the ink-receiving layer are open to (connect with) and preferably (but not necessarily) have a void size similar to the voids in the ionomer-containing microvoided substrate layer for optimal interlayer absorption.

Interconnecting voids in an image-receiving layer may be obtained by a variety of methods. For example, the layer may contain particles dispersed in a polymeric binder. The particles may be organic such as poly(methyl methacrylate), polystyrene, poly(butyl acrylate), etc. or inorganic such as silica, alumina, zirconia, titania, calcium carbonate, and barium sulfate. In a preferred embodiment of the invention, the particles have a particle size of from about 5 nm to about 15 μm.

The polymeric binder which may be used in the image-recording layer of the invention, can be, for example, a hydrophilic polymer such as poly(vinyl alcohol), polyvinyl acetate, polyvinyl pyrrolidone, gelatin, poly(2-ethyl-2-oxazoline), poly(2-methyl-2-oxazoline), poly(acrylamide), chitosan, poly(ethylene oxide), methyl cellulose, ethyl cellulose, hydroxyethyl cellulose, hydroxypropyl cellulose, etc. Other binders can also be used such as hydrophobic materials such as poly(styrene-co-butadiene), a polyurethane latex, a polyester latex, poly(n-butyl acrylate), poly(n-butyl methacrylate), poly(2-ethylhexyl acrylate), a copolymer of n-butylacrylate and ethylacrylate, a copolymer of vinylacetate and n-butylacrylate, etc.

In another preferred embodiment of the invention, the volume ratio of the particles to the polymeric binder is from about 1:1 to about 15:1.

Other additives may also be included in the image-receiving layer such as pH-modifiers like nitric acid, cross-linkers, rheology modifiers, surfactants, UV-absorbers, biocides, lubricants, dyes, dye-fixing agents or mordants, optical brighteners etc.

An image-receiving layer may be applied to one or both substrate surfaces through conventional pre-metered or post-metered coating methods such as blade, air knife, rod, roll coating, etc. The choice of coating process would be determined from the economics of the operation and in turn, would determine the formulation specifications such as coating solids, coating viscosity, and coating speed.

The image-receiving layer thickness may range from about 1 to about 60 μm, preferably from about 5 to about 40 μm.

After coating, the inkjet recording element may be subject to calendaring or supercalendering to enhance surface smoothness.

Inkjet inks used to image the recording elements of the present invention are well known in the art. The ink compositions used in inkjet printing typically are liquid compositions comprising a solvent or carrier liquid, dyes or pigments, humectants, organic solvents, detergents, thickeners, preservatives, and the like. The solvent or carrier liquid can be solely water or can be water mixed with other water-miscible solvents such as polyhydric alcohols. Inks in which organic materials such as polyhydric alcohols are the predominant carrier or solvent liquid may also be used. Particularly useful are mixed solvents of water and polyhydric alcohols. The dyes used in such compositions are typically water-soluble direct or acid type dyes. Such liquid compositions have been described extensively in the prior art including, for example, U.S. Pat. Nos. 4,381,946; 4,239,543 and 4,781,758, the disclosures of which are hereby incorporated by reference.

The following examples further illustrate the invention.

EXAMPLES

Examples of the preparation of an ink-permeable polyester microvoided substrate layer in accordance with the present invention, and comparisons or controls, are as follows:

Control 1

A three-layered polyester substrate comprising an impermeable core polyester layer and an ink-permeable upper and lower polyester microvoided substrate layer is prepared in the following manner. The materials used in the preparation are (1) a poly(ethylene terephthalate) (PET) resin (IV=0.70 dl/g ) for the core layer; and (2) a compounded blend for the upper and lower substrate layers consisting of 29% by weight of an amorphous polyester resin, PETG 6763® resin (IV=0.73 dl/g) (Eastman Chemical Company), 29% by weight poly(ethylene terephthalate) (PET) resin (IV=0.70 dl/g), and 42% by weight of cross-linked PMMA particles approximately 1.7 um in size.

PETG 6763 is a poly(1,4-cyclohexylene dimethylene terephthalate) copolyester from Eastman Chemicals containing at least 95 mole percent terephthalic acid, 65 to 90 mole percent ethylene glycol and 35 to 10 mole percent CHDM, that is, a modified PET based on terephthalic acid, ethylene glycol, and 1,4-cyclohexanedimethanol, produced and sold by Eastman Chemical Company.

The cross-linked PMMA particles were compounded with the PETG 6763® and the PET resins through mixing in a counter-rotating twin-screw extruder attached to a pelletizing die. The extrudate was passed through a water bath and pelletized.

The two resins for the three layers were dried at 65° C. and fed by two plasticating screw extruders into a coextrusion die manifold to produce a three-layered melt stream which was rapidly quenched on a chill roll after issuing from the die. By regulating the throughputs of the extruders, it was possible to adjust the thickness ratio of the layers in the cast laminate sheet. In this case, the thickness ratio of the three layers was adjusted at 1:6:1 with the thickness of the two outside layers being approximately 250 μm. The cast sheet was first oriented in the machine direction by stretching at a ratio of 3.3 and a temperature of 110° C.

The oriented substrate was then stretched in the transverse direction in a tenter frame at a ratio of 3.3 and a temperature of 100° C. In this example, no heat setting treatment was applied. The final total film thickness was 200 μm with the permeable top and bottom layers being 50 μm each, and the layers within the substrate were-fully integrated and strongly bonded. The stretching of the heterogeneous top and bottom layers created interconnected microvoids around the hard cross-linked PMMA beads, thus rendering this layer opaque (white) and highly porous and permeable. The PET core layer, however, was impermeable and retained its natural clarity.

Control 2

A two-layered polyester microvoided substrate comprising an impermeable base polyester layer and an ink-permeable upper polyester layer is prepared in the following manner. The materials used in the preparation are:

(1) a poly(ethylene terephthalate) (PET) resin (IV=0.70 dl/g) for the base layer;

(2) a compounded blend consisting of 29% by weight of an amorphous polyester resin, PETG 6763 (O) resin (IV=0.73 dl/g) (Eastman Chemical Company), 29% by weight poly(ethylene terephthalate) (PET) resin (IV=0.70 dl/g), and 42% by weight of cross-linked PMMA microbeads approximately 1.7 um in size for the top layer.

The cross-linked PMMA microbeads were compounded with the PETG 6763® and the PET resins through mixing in a counter-rotating twin-screw extruder attached to a pelletizing die. The resins were dried at 65° C. and fed by two plasticating screw extruders into a coextrusion die manifold to produce a two-layered melt stream which was rapidly quenched on a chill roll after issuing from the die. By regulating the throughputs of the extruders, it was possible to adjust the thickness ratio of the layers in the cast laminate sheet. In this case, the thickness ratio of the two layers was adjusted at 1:1 with the thickness of the absorbing layer being approximately 450 μm. The cast sheet was oriented in both the machine and transverse directions by stretching at a ratio of 3.3 and a temperature of 100° C.

In this example, no heat setting treatment was applied. The final total film thickness was 140 μm with the permeable layer being 95 μm, and the layers within the substrate were fully integrated and strongly bonded. The stretching of the heterogeneous top layer created interconnected microvoids around the cross-linked PMMA microbeads, thus rendering this layer opaque (white) and highly porous and permeable. The PET base layer, however, was impermeable and retained its natural clarity.

Example 1

A two-layered polyester microvoided substrate comprising an impermeable base polyester layer and an ink-permeable upper polyester layer is prepared in the following manner. The materials used in the preparation are:

1) a poly(ethylene terephthalate) (PET) resin (IV=0.70 dl/g) for the base layer;

2) a compounded blend consisting of 14.5% by weight of a sulphonated polyester (Eastman Chemical's AQ 55S®, Diglycol/CHDM/Isophthalates/SIP copolymer), 43.5% by weight poly(ethylene terephthalate) (PET) resin (IV=0.70 dl/g), and 42% by weight of cross-linked PMMA microbeads approximately 1.7 um in size for the top layer.

The cross-linked PMMA microbeads were compounded with the AQ 55S® and the PET resins through mixing in a counter-rotating twin-screw extruder attached to a pelletizing die. The resins were dried at 65° C. and fed by two plasticating screw extruders into a coextrusion die manifold to produce a two-layered melt stream which was rapidly quenched on a chill roll after issuing from the die. By regulating the throughputs of the extruders, it was possible to adjust the thickness ratio of the layers in the cast laminate sheet. In this case, the thickness ratio of the two layers was adjusted at 1:1 with the thickness of the absorbing layer being approximately 450 μm. The cast sheet was oriented in both the machine and transverse directions by stretching at a ratio of 3.3 and a temperature of 100° C.

In this example, no heat setting treatment was applied. The final total film thickness was 140 μm with the permeable layer being 95 μm, and the layers within the substrate were fully integrated and strongly bonded. The stretching of the heterogeneous top layer created interconnected microvoids around the cross-linked PMMA microbeads, thus rendering this layer opaque (white) and highly porous and permeable. The PET base layer, however, was impermeable and retained its natural clarity.

Example 2

A two-layered polyester microvoided substrate comprising an impermeable base polyester layer and an ink-permeable upper polyester layer is prepared in the following manner. The materials used in the preparation are:

1) a poly(ethylene terephthalate) (PET) resin (IV=0.70 dl/g) for the base layer;
2) a compounded blend consisting of 29% by weight of a sulphonated polyester (Eastman Chemical's AQ 55S®, Diglycol/CHDM/Isophthalates/SIP copolymer), 29% by weight poly(ethylene terephthalate) (PET) resin (IV=0.70 dl/g), and 42% by weight of cross-linked PMMA microbeads approximately 1.7 um in size for the top layer.

The cross-linked PMMA microbeads were compounded with the AQ 55S® and the PET resins through mixing in a counter-rotating twin-screw extruder attached to a pelletizing die. The resins were dried at 65° C. and fed by two plasticating screw extruders into a coextrusion die manifold to produce a two-layered melt stream which was rapidly quenched on a chill roll after issuing from the die. By regulating the throughputs of the extruders, it was possible to adjust the thickness ratio of the layers in the cast laminate sheet. In this case, the thickness ratio of the two layers was adjusted at 1:1 with the thickness of the absorbing layer being approximately 450 μm. The cast sheet was oriented in both the machine and transverse directions by stretching at a ratio of 3.3 and a temperature of 100° C.

In this example, no heat setting treatment was applied. The final total film thickness was 140 μm with the permeable layer being 95 μm, and the layers within the substrate were fully integrated and strongly bonded. The stretching of the heterogeneous top layer created interconnected microvoids around the cross-linked PMMA microbeads, thus rendering this layer opaque (white) and highly porous and permeable. The PET base layer, however, was impermeable and retained its natural clarity.

Example 3

A two-layered polyester microvoided substrate comprising an impermeable base polyester layer and an ink-permeable upper polyester layer is prepared in the following manner. The materials used in the preparation are:

1) a poly(ethylene terephthalate) (PET) resin (IV=0.70 dl/g) for the base layer;
2) a compounded blend consisting of 14.5% by weight of a sulphonated polyester (Eastman Chemical's AQ 55S®, Diglycol/CHDM/Isophthalates/SIP copolymer), 43.5% by weight PETG 6763® resin (IV=0.73 dl/g) (Eastman Chemical Company), and 42% by weight of cross-linked PMMA microbeads approximately 1.7 um in size for the top layer.

The cross-linked PMMA microbeads were compounded with the AQ 55S® and the PET resins through mixing in a counter-rotating twin-screw extruder attached to a pelletizing die. The resins were dried at 65° C. and fed by two plasticating screw extruders into a coextrusion die manifold to produce a two-layered melt stream which was rapidly quenched on a chill roll after issuing from the die. By regulating the throughputs of the extruders, it was possible to adjust the thickness ratio of the layers in the cast laminate sheet. In this case, the thickness ratio of the two layers was adjusted at 1:1 with the thickness of the absorbing layer being approximately 450 μm. The cast sheet was oriented in both the machine and transverse directions by stretching at a ratio of 3.3 and a temperature of 100° C.

In this example, no heat setting treatment was applied. The final total film thickness was 140 μm with the permeable layer being 95 μm, and the layers within the substrate were fully integrated and strongly bonded. The stretching of the heterogeneous top layer created interconnected microvoids around the cross-linked PMMA microbeads, thus rendering this layer opaque (white) and highly porous and permeable. The PET base layer, however, was impermeable and retained its natural clarity.

Example 4

A two-layered polyester microvoided substrate comprising an impermeable base polyester layer and an ink-permeable upper polyester layer is prepared in the following manner. The materials used in the preparation are:

1) a poly(ethylene terephthalate) (PET) resin (IV=0.70 dl/g) for the base layer;
2) a compounded blend consisting of 29% by weight of a sulphonated polyester (Eastman Chemical's AQ 55S®, Diglycol/CHDM/Isophthalates/SIP copolymer), 29% by weight PETG 6763 ® resin (IV=0.73 dl/g) (Eastman Chemical Company), and 42% by weight of cross-linked PMMA microbeads approximately 1.7 um in size for the top layer.

The cross-linked PMMA microbeads were compounded with the AQ 55S®and the PET resins through mixing in a counter-rotating twin-screw extruder attached to a pelletizing die. The resins were dried at 65° C. and fed by two plasticating screw extruders into a coextrusion die manifold to produce a two-layered melt stream which was rapidly quenched on a chill roll after issuing from the die. By regulating the throughputs of the extruders, it was possible to adjust the thickness ratio of the layers in the cast laminate sheet. In this case, the thickness ratio of the two layers was adjusted at 1:1 with the thickness of the absorbing layer being approximately 450 μm. The cast sheet was oriented in both the machine and transverse directions by stretching at a ratio of 3.3 and a temperature of 100° C.

In this example, no heat setting treatment was applied. The final total film thickness was 140 μm with the permeable layer being 95 μm, and the layers within the substrate were fully integrated and strongly bonded. The stretching of the heterogeneous top layer created interconnected microvoids around the cross-linked PMMA microbeads, thus rendering this layer opaque (white) and highly porous and permeable. The PET base layer, however, was impermeable and retained its natural clarity.

Ink Receiving Layer

The composition for the porous ink-receiving layer contained the following components:

Water: 66 parts

Aerosil Moxi® 80 silica (Degussa Corporation): 8 parts

Nalco® 2329 colloidal silica (Nalco Chemical Co.): 18 parts

N-(2-aminoethyl)-3-aminopropylmethyldimethoxysilane (United Chemicals Technologies, Inc.): 1 part Styrene/butyl acrylate core shell latex: 7 parts The Aerosil Mox® 80 silica was added to a 40% solution of Nalco® 2329 colloidal silica with stirring over a one hour time period. N-(2-aminoethyl)-3-aminopropylmethyldimethoxysilane was added to this mixture and the mixture was sonicated for 12 hours. The styrene/butyl acrylate core shell latex was added to the resulting solution and stirred for 30 minutes.

The ink-permeable polyester microvoided substrates described above were coated at room temperature with the ink receiving layer porous composition using a rod coater to give a dry thickness of 20 microns. The coating was allowed to air dry for 12 hours before printing.

Printing

Images were printed using a Mutoh® 3038 wide format printer and Epson® 9500 pigment based inks with cartridges Black T474, Yellow T475, Magenta T476 and Cyan T477. The images contained 25%, 50%, 75% and 100% ink coverage blocks of cyan, magenta, yellow, red, green, blue and black colors. These blocks were approximately 1 cm by 1 cm in size. In addition, the images contained 100% ink coverage blocks of cyan, magenta, yellow, red, green, blue and black adjacent to each other for drytime measurements. These blocks were approximately 1 cm by 1.5 cm in size.

Drytime Testing

Immediately after ejection from the printer, the printed image was set on a flat surface. The seven adjacent color blocks were then wiped with the index finger under normal pressure in one pass. The index finger was covered with a rubber finger cot. The drytime was rated as 5 when all of the color blocks smeared after wiping. The drytime was rated as 1 when no smearing was observed. Intermediate drytimes were rated between 1 and 5.

Coalescence Testing

Coalescence is an unwanted imaging artifact in which ink puddles at the surface and leads to non-uniform densities. This is usually most obvious in the printed areas containing secondary colors such as red, green and blue as well as black. The coalescence was rated visually by inspecting the red, green and blue color blocks. A rating of 1 indicated no observed coalescence. A rating of 5 indicated severe coalescence. Intermediate coalescence artifacts were rated between 1 and 5.

Image Density Measurement

The densities of the 100% ink coverage magenta blocks in the printed images were measured using an X-Rite® Densitometer Model 820. Densities of 1.0 or greater are considered acceptable for most imaging applications.

The results of the above described testing and measurements are shown in Tables 1 and 2 below:

TABLE 1

| Intermediate Element | Coated Ink-receiving Layer | Drytime | Coalescence |
|---|---|---|---|
| 1 | No | 1 | 1 |
| 2 | No | 1 | 1 |
| 3 | No | 1 | 1 |
| 4 | No | 1 | 1 |
| Control 1 | No | 1 | 1 |
| Control 2 | No | 1 | 1 |

The results in Table 1 show that all the elements tested, before coating an ink-receiving layer on the microvoided substrate, exhibited good drytime and coalescence, even the controls.

TABLE 2

| Element | Coated Ink-receiving Layer | Drytime | Coalescence | Density |
|---|---|---|---|---|
| 1 (Invention) | Yes | 1.5 | 2 | 1.24 |
| 2 (Invention) | Yes | 1 | 2 | 1.32 |
| 3 (Invention) | Yes | 1.5 | 1 | 1.18 |
| 4 (Invention) | Yes | 1 | 1 | 1.15 |
| Control 1 | Yes | 4 | 3 | 1.33 |
| Control 2 | Yes | 3 | 4 | 1.33 |

The results in Table 2 show that receiving elements according to the invention gave good drytimes, good coalescence results and good image densities, as compared to the control elements. While control elements 1 and 2 show good printed densities, they are inferior for drytime and coalescence.

This invention has been described with particular reference to preferred embodiments thereof, but it will be understood that modifications can be made within the spirit and scope of the invention.

What is claimed is:

1. An inkjet recording element comprising a porous ink-receiving layer over and adjacent to an ink-permeable microvoided substrate layer comprising, in a polyester continuous phase a non-ionic polyester and, a polyester ionomer, the microvoided substrate layer comprising:

(a) 5 to 70 percent by weight solids of said non-ionic polyester;

(b) 5 to 40 percent by weight solids of said polyester ionomer;

(c) 25 to 65 percent by weight of a voiding agent;

based on the total weight of the microvoided substrate layer and wherein the microvoided substrate layer and the porous ink-receiving layer both having interconnecting voids.

2. The inkjet recording element of claim 1 wherein the microvoided substrate layer has an ink absorbency rate resulting in a drytime of less than about 10 seconds.

3. The inkjet recording element of claim 1 wherein the microvoided substrate layer has a total absorbent capacity of at least about 14 cc/$m^2$.

4. The inkjet recording element of claim 1 wherein, on a side opposite the ink-receiving layer, the microvoided substrate layer is adjacent a substantially ink-impermeable polyester base layer.

5. The inkjet recording element of claim 4 wherein the microvoided substrate layer and the base layer are coextruded.

6. The inkjet recording element of claim 4 further comprising a polyester microvoided lower layer under and adjacent to the base layer on an opposite side from the ink-permeable microvoided substrate layer, wherein the lower layer has interconnecting voids.

7. The inkjet recording element of claim 6 wherein the microvoided substrate layer, base layer, and lower layer are coextruded and form a support for a coated ink-receiving layer.

8. The recording element of claim 4 wherein the base layer comprises a voiding agent to an extent less than about 25% by volume.

9. The recording element of claim 8 wherein the base layer comprises poly(ethylene terephthalate).

10. The recording element of claim 1 wherein the non-ionic polyester comprises poly(ethylene terephthalate), poly (ethylene-1,4-cyclohexylenedimethylene terephthalate), or blends thereof.

11. The recording element of claim 1 wherein the microvoided substrate layer comprises a voiding agent present in an amount of from about 30% to about 50% by volume of the microvoided substrate layer.

12. The recording element of claim 11 wherein the voiding agent comprises particles having an average particle size of from about 5 nm to about 15 μm.

13. The inkjet recording element of claim 1 consisting essentially of the porous ink-receiving layer and the microvoided substrate layer, wherein the substrate layer is a single layer forming a support for the porous ink-receiving layer.

14. The recording element of claim 4 further comprising paper laminated to a side of the base layer on a side of the base layer not having thereon the ink-receiving layer.

15. The recording element of claim 1 wherein the microvoided substrate layer is a biaxially oriented material.

16. The recording element of claim 1 wherein the microvoided substrate layer has a dry thickness of from about 25 to about 400 μm.

17. The inkjet recording element of claim 1 wherein the polyester ionomer is a sulfonated polyester.

18. The inkjet recording element of claim 1 wherein the polyester ionomer comprises ionic groups selected from the group consisting of sulfonic acid, sulfonimide, and compatible combinations thereof.

19. The inkjet recording element of claim 1 wherein the polyester ionomer comprises monomeric units derived from monomers selected from the group consisting of 5-sodiosulfobenzene-1,3-dicarboxylic acid, 5-sodiosulfocyclohexane-1,3-dicarboxylic acid, 5-(4-sodiosulfophenoxy)benzene-1,3-dicarboxylic acid, 5-(4-sodiosulfophenoxy)cyclohexane-1,3-dicarboxylic acid, equivalent salt forms of the foregoing compounds, and combinations thereof.

20. The inkjet recording element of claim 1 wherein the polyester ionomer comprises monomeric units derived from a sulfonic-acid substituted aromatic dicarboxylic acid selected from the group consisting of:

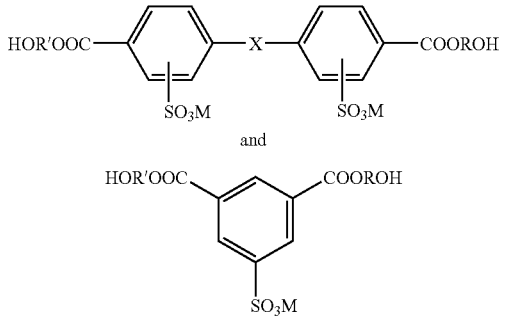

wherein X represents:

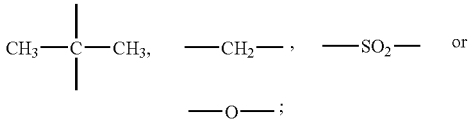

R and R' each represent $—(CH_2)_n—$ where n represents an integer of 1 to 20; and M represents sodium, potassium or lithium ions.

21. The inkjet recording element of claim 20 wherein the sulfonic-acid substituted aromatic dicarboxylic acid is selected from the group consisting of 5-sodium sulfoisophthalic acid, 2-sodium sulfoisophthalic acid, 4-sodium sulfoisophthalic acid, 4-sodium sulfo-2,6-naphthalene dicarboxylic acid, an ester-forming derivative thereof, a compound in which each of these sodiums is substituted by another metal, and combinations thereof.

22. The inkjet recording element of claim 1 wherein the polyester ionomer comprises monomeric units derived from a polyol selected from the group consisting of ethylene glycol, diethylene glycol, triethylene glycol, 1,3-propanediol, 1,4-butanediol, 2-methyl-1,5-pentanediol, neopentyl glycol, 1,4-cyclohexanedimethanol, 1,4-bis(β-hydroxyethoxy)cyclohexane, quinitol, norcamphanediols, 2,2,4,4-tetraalkylcyclobutane-1,3-diols, p-xylene diol, bisphenol A, and combinations thereof.

23. The inkjet recording element of claim 1 wherein the polyester ionomer comprises a polymeric reaction product of: a first dicarboxylic acid; a second dicarboxylic acid comprising an aromatic nucleus to which is attached a sulphonic acid group; an aliphatic diol, and an aliphatic cycloaliphatic diol.

24. The inkjet recording element of claim 23 wherein the second dicarboxylic acid comprises from about 2 to 25 mol percent of the total moles of first and second dicarboxylic acids and the aliphatic cycloaliphatic diol comprises from about 0 to 50 mol percent of the total moles of both diols.

25. The recording element of claim 1 wherein the porous ink-receiving layer having interconnecting voids comprises particles dispersed in a polymeric binder.

26. The recording element of claim 25 wherein the particles are inorganic.

27. The recording element of claim 26 wherein the inorganic particles comprise silica, alumina, zirconia, titania, calcium carbonate, or barium sulfate.

28. The recording element of claim 25 wherein the particles are organic.

29. The recording element of claim 25 wherein the particles have a particle size of from about 5 nm to about 15 μm.

30. The recording element of claim 25 wherein the polymeric binder comprises a hydrophilic binder.

31. The recording element of claim 30 wherein the hydrophilic binder comprises poly(vinyl alcohol), poly(vinyl acetate), poly(vinyl pyrrolidone), gelatin, poly(2-ethyl-2-oxazoline), poly(2-methyl-2-oxazoline), poly(acrylamide), chitosan, poly(ethylene oxide), methyl cellulose, ethyl cellulose, hydroxyethyl cellulose, or hydroxypropyl cellulose.

32. The recording element of claim 25 wherein the polymeric binder comprises a hydrophobic binder.

33. The recording element of claim 32 wherein the hydrophobic binder comprises poly(styrene-co-butadiene), a polyurethane latex, a polyester latex, poly(n-butyl acrylate), poly(n-butyl methacrylate), poly(2-ethylhexyl acrylate), a copolymer of n-butylacrylate and ethylacrylate, or a copolymer of vinylacetate and n-butylacrylate.

34. The recording element of claim 25 wherein the volume ratio of the particles to the polymeric binder is from about 1:1 to about 15:1.

35. An inkjet printing process, comprising the steps of:

A) providing an inkjet printer that is responsive to digital data signals;

B) loading the printer with an inkjet recording element as described in claim 1;

C) loading the printer with an inkjet ink composition; and

D) printing on the inkjet recording element using the inkjet ink composition in response to the digital data signals.

* * * * *